US005222830A

United States Patent [19]

Raguse

[11] Patent Number: 5,222,830

[45] Date of Patent: Jun. 29, 1993

[54] COMBINED DOCK AND BOAT LIFT

[75] Inventor: Lyle T. Raguse, Wheaton, Minn.

[73] Assignee: Combo Manufacturing, Inc., Wheaton, Minn.

[21] Appl. No.: 821,020

[22] Filed: Jan. 15, 1992

[51] Int. Cl.[5] ..... B63C 1/00

[52] U.S. Cl. ..... 405/3; 405/218; 114/44

[58] Field of Search ..... 414/546, 678; 114/44, 114/45, 365; 405/1-4, 218-221

[56] References Cited

U.S. PATENT DOCUMENTS

| | | | |
|---|---|---|---|
| 2,963,176 | 12/1960 | Smith | 414/678 X |
| 3,021,965 | 2/1962 | Harvey | 414/678 |
| 3,043,109 | 7/1962 | Erickson | 405/220 |
| 3,126,855 | 3/1964 | Freeburg | 114/263 X |
| 3,229,833 | 1/1966 | Heck et al. | 405/218 X |
| 3,262,139 | 7/1966 | Campbell | 405/218 X |
| 3,380,257 | 4/1968 | Gillman et al. | 405/221 |
| 3,601,269 | 8/1971 | Heinig | 414/462 X |
| 3,675,258 | 7/1972 | Osmundson | 414/678 X |
| 3,824,796 | 7/1974 | Nasby, Jr. | 405/220 |
| 4,022,027 | 5/1977 | Tetzner | 405/3 |
| 4,027,492 | 6/1977 | Carpenter | 414/678 X |
| 4,318,632 | 3/1982 | Fortmeyer | 405/3 |
| 4,505,619 | 3/1985 | Sargent | 114/263 X |
| 4,589,800 | 5/1986 | Nasby, Jr. | 405/221 |
| 4,601,606 | 7/1988 | Eason | 405/1 |
| 4,787,327 | 11/1988 | Porter | 414/678 X |
| 4,864,951 | 9/1989 | Koepp | 414/678 X |
| 5,016,685 | 5/1991 | Fender | 114/45 |

FOREIGN PATENT DOCUMENTS

| | | | |
|---|---|---|---|
| 792095 | 8/1968 | Canada . | |
| 1173236 | 2/1959 | France | 405/3 |
| 1118581 | 10/1984 | U.S.S.R. | 405/3 |
| 2046181 | 11/1980 | United Kingdom | 405/1 |

OTHER PUBLICATIONS

Dock Rite Inc. brochure, "Docks & Boat Lifts", Sep. 1990.

Hewitt Manufacturing, Inc. brochure, "Boat and Pontoon Lifts".

ShoreMaster, Inc. brochure, "ShoreMaster's Residential Waterfront Equipment".

Porta-Dock, Inc. brochure, "The Finest in Docks and Boat Lifts".

*Primary Examiner*—Randolph A. Reese
*Assistant Examiner*—John Ricci
*Attorney, Agent, or Firm*—Merchant, Gould, Smith, Edell, Welter & Schmidt

[57] ABSTRACT

A portable dock is shown having a deck with a portion providing a support platform for a boat lift. A boat lift is pivotally connected to the platform so that the boat lift can be pivoted from a position adjacent the dock to an inverted position on and supported by the platform. A hoist guide is mounted above the deck and connected to the boat lift so that the boat lift can be lifted up, pivoted over center and released to rest in an inverted position on the support platform.

23 Claims, 3 Drawing Sheets

COMBINED DOCK AND BOAT LIFT

BACKGROUND OF THE INVENTION

1. Field of the Invention

The present invention relates generally to portable docks and to boat lifts, and more particularly relates to an arrangement for combining a boat lift with a portable dock so that the boat lift can be pivotally hoisted from a position adjacent the dock to an inverted position on the dock for easy transport and storage.

2. Description of the Prior Art

Mobile dock structures have been developed which permit the user to easily move the dock structure in and out of the water. Such dock structures typically have an elongated deck supported by a metal frame, with one end of the unit being provided with wheels so that the dock can be handled like a trailer. A portable dock structure of this nature is shown in the Charles L. Nasby, Jr. U.S. Pat. No. 3,824,796, issued July 23, 1974.

Various boat lift structures have also been developed which can be used to raise and lower a boat to positions in or out of the water. Such boat lifts typically include a main frame positioned on the ground and a lift frame which can be raised or lowered with respect to the main frame. A manually operable winch and cable arrangement is usually provided so that the operator can manually raise or lower the boat. In many cases, such a boat lift is positioned adjacent a dock so that the operator can stand on the dock while operating the winch.

Particularly in areas where lakes freeze during the winter, it is necessary to remove boat lifts from the water in the fall and place them back in the water in the spring. The usual way of moving a boat lift is to manually lift it and move it in or out of the water. Because boat lifts are heavy, it may be necessary to employ several people to perform this task, and the task can be very difficult particularly if the weather is inclement. Some attempts have been made in the past to make this task easier, as for example by providing means to float a boat lift to or away from its desired location. Such a device is shown in the Norman N. Fender U.S. Pat. No. 5,016,685, issued May 21, 1991. The George W. Fortmeyer U.S. Pat. No. 4,318,632, issued Mar. 9, 1982, discloses a boat lift having retractable wheels to facilitate its placement or removal from a dockside location. It is also possible to dismantle boat lifts to facilitate their removal or placement.

While adding extra features to boat lifts may be preferable to moving them manually, such features do add additional complexity and are costly. Therefore, it would be preferable to keep the construction of the boat lift as simple as possible while at the same time providing for some mechanized way of easily removing it from or placing it in the water.

SUMMARY OF THE INVENTION

The present invention provides a mechanism for quickly and easily placing in or removing from the water a boat lift while at the same time not adding any structures or features to the boat lift which will increase its cost or complexity. Because owners and users of boat lifts also need a dock, it was recognized that the portability and trailer-like features of a portable dock could be used to also transport a boat lift. The present invention also recognizes that the two units are often placed directly adjacent each other in the water. In order to take advantage of this fact, means are provided to pivotally connect the boat lift to the portable dock, together with a raising and lowering mechanism, so that the boat lift can be pivotally hoisted from a position adjacent the dock to an inverted position on the dock. In this position, the boat lift can be removed from the water along with the portable dock. Means are provided to use the hoist mechanism that is normally part of the boat lift, and which includes an associated winch and line or cable operated thereof, to raise and lower the boat lift with respect to the dock. As a result, a single operator can accomplish the transfer without entering the water.

DESCRIPTION OF PREFERRED EMBODIMENT

Figure 1:
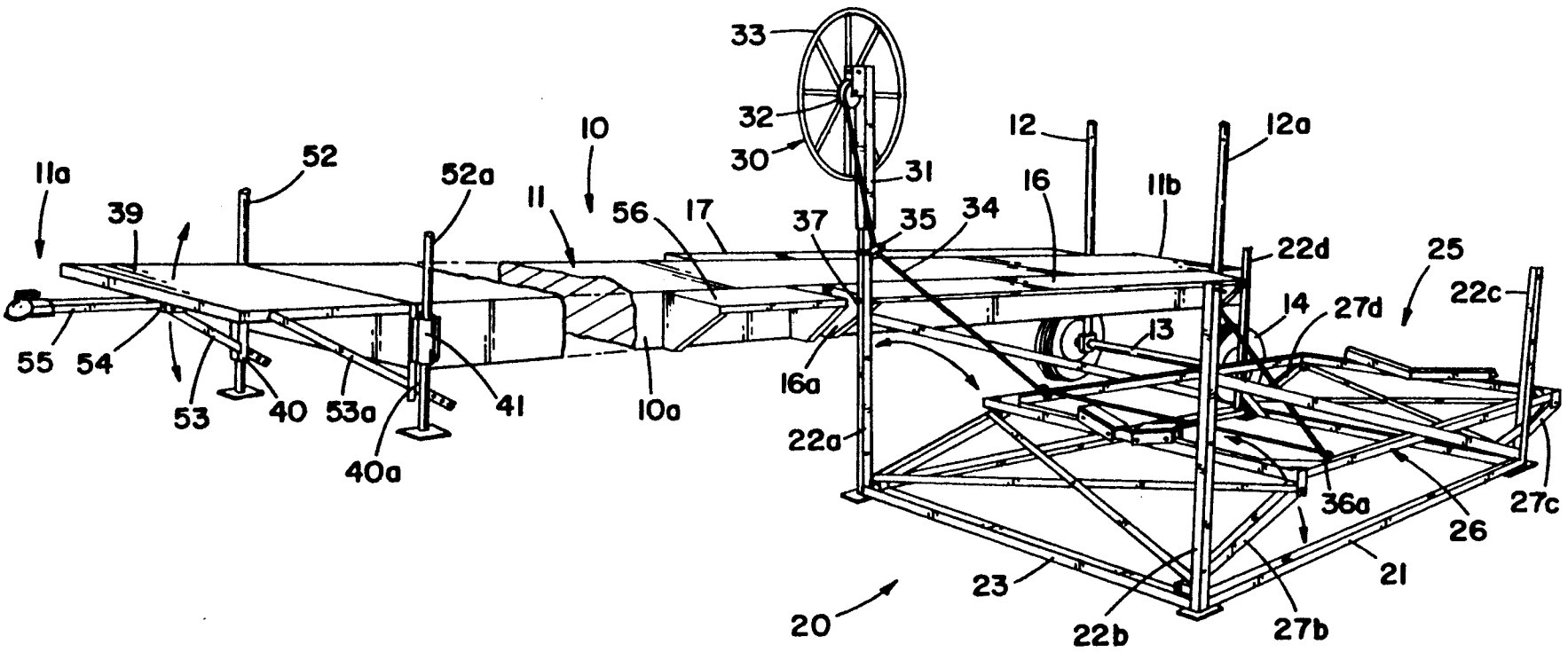
FIG. 1 is a view in perspective from the front end and one side of a combination portable dock and boat lift according to the present invention, showing both in position for use.

Referring now to the drawings, wherein like numerals are used throughout the several views to identify like elements of the invention, there is disclosed in FIG. 1 a portable dock 10 having an elongated deck 11 with an inner end 11*a* and an outer end 11*b*. Dock 10 is supported at its outer end 11*b* by a pair of upright supports 12, 12*a* which extend both above and below deck 11 generally vertically on opposite sides thereof. Upright supports 12 and 12*a* are bolted (or welded) to the opposite sides 10*a* and 10*b* of dock 10. Mounted at the bottom ends of supports 12, 12*a* is an axle 13 carrying a pair of wheels 14, 14*a* at its opposite ends. Adjustment means (not shown) are provided in the supports 12, 12*a* to raise or lower dock 10 with respect to wheels, 14, 14*a*.

A pair of oppositely disposed deck extensions 16, 17 are bolted or otherwise secured to the opposite side walls 10*a*, 10*b* of dock 10 near the outer end of the dock.

Located adjacent side 10*a* of dock 10 is a boat lift 20 having a main, generally rectangular frame 21 which includes four normally vertically extending corner posts 22*a*, 22*b*, 22*c*, 22*d*. Main frame 21 also includes four base members 23 connecting the corner posts 22 generally at their bottom ends.

Disposed within the main frame 21 is a lift frame 25 which includes a generally horizontally disposed boat cradle assembly 26 supported for pivotal movement, as shown by arrow 27, by four corner support members 27*a*, 27*b*, 27*c* and 27*d* which are each hinged at their opposite ends respectively to base members 23 and boat cradle 26. As will be recognized by those skilled in the art, corner support members 27 can be pivoted to lower or raise a boat positioned on cradle 25 into or out of the water in which the boat lift is located.

To accomplish this raising and lowering, a removable winch assembly 30 is mounted on corner post 22*a*. Winch assembly 30 comprises a winch support post 31 which is a tubular member having an insert member 31*a* extending from one end thereof that fits into hollow corner post 22*a*. Mounted at the top end of winch support post 31 is a winch in the nature of a ratchet and pawl assembly 32 operable by a wheel 33. Winch 32 carries a cable 34 which extends through a guide member 35 attached to the top of corner post 22*a*, guide members 36, 36*a* attached to the opposite sides of boat cradle 26, with the end of cable 34 being attached to the top end of corner post 22*b*. With the boat lift 20 being located adjacent dock 10 as shown in FIG. 1, an operator can stand on deck 11 and operate wheel 33 to in turn operate winch 32 to either pull in or slowly release cable 34 to raise or lower lift frame 25. Such winch assemblies are well known in the art and need not be further described here.

Deck extensions 16 and 17 each comprise an elongated generally rectangular deck portion having an upper surface positioned co-planar with the surface of deck 11 and oppositely disposed generally triangular support members 16*a*, 17*a* connected to the ends of the deck portions. The width of each deck extension is such that when the two deck extensions are combined with the deck surface a platform is provided which is about the same size as the boat lift 20. As shown in FIG. 1, the length of deck extension 16 is such that is fits between and closely adjacent corner posts 22*a*, 22*d* of back left 20. A pair of pins 37 extend through openings in corner posts 22*a*, 22*d* into the outer corners of deck extension 16 to define a pivot axis about which the boat lift 20 can swivel with respect to the dock 10.

Inner end 11*a* of dock 10 is provided with a ramp 39 which is connected by hinges to the end of dock 10 so that it can freely move upwardly and downwardly as suggested by the arrows. End 11*a* has a pair of vertical angle irons 40, 40*a* attached thereto which carry tubes 41 through which a pair of pipe-like vertical legs 52, 52*a* extend, which can be adjusted with respect to the pipes 41 to support dock 10 at the desired level. Ramp 39 is further supported by a pair of rearwardly and downwardly extending links 53, 53*a*. Links 53, 53*a* are pivotally attached near the outer end of ramp 39 and their other ends extend through slots in angle irons 40, 40*a* for movement therein as the ramp moves upwardly and downwardly. The free ends of links 53, 53*a* are provided with a plurality of holes through which bolts can be inserted to hold ramp 39 in the position shown when the dock is being moved. Mounted to the under surface of ramp 39 near its free end is a section of rectangular tube 54 through which extends a removable trailer hinge 55. A removable pin extends through tube 54 and hinge 55 to hold the hitch in place, and the inner end of hitch 55 (not shown) extends through a similar tube to hold it in place. Hitch 55 can easily be removed by taking out the single pin in member 54.

It can be seen that ramp 39 can be adjusted to different positions depending upon the relationship of the dock to the shoreline. The inner end of dock 10 is supported at a desired level by legs 52, 52*a*. Hitch 55 can be removed and ramp 39 can be moved upwardly and downwardly depending upon the relationship of the ground surface to the surface of deck 11.

Dock 10 is also provided with a third, shorter deck extension 56 just below the area of the winch assembly 30 to provide an additional platform for an operator to stand on while operating the wheel 33. The outer end of extension 56 is spaced a short distance from the inner end of deck extension 16 to provide room for the top end of corner post 22*a* to move there between as boat lift 20 is pivoted upwardly onto the dock.

Although the drawings show boat lift 20 located on one side of dock 10, it should be noted that boat lift 20 could be positioned on the opposite side of dock 10 adjacent deck extension 17 and all of the connections reversed to operate from that side of the dock.

Figure 5:
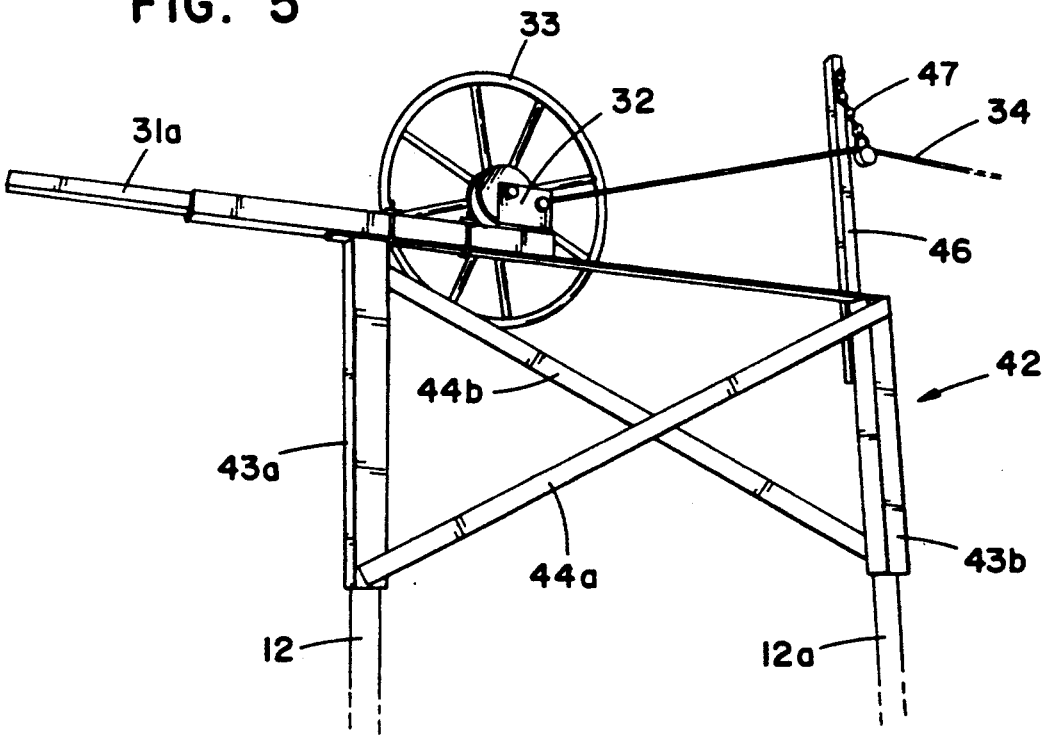
FIG. 5 is an enlarged fragmentary view in perspective of the hoisting mechanism shown in FIG. 2.

When it is desired to pivot the boat lift from a position adjacent the dock to a position on and supported by the platform, winch assembly 30 is moved to a different location. Referring to FIG. 5, a support frame structure 42 is provided which extends between and is mounted on upright supports 12, 12*a*. Support frame structure 42 has a pair tubular sleeve members 43*a*, 43*b* which are sized to fit over upright supports 12, 12*a*, a pair of diagonally extending cross braces 44*a*, 44*b*, and a top frame member 45 extending between and connected to and closing the top ends of sleeve members 43*a*, 43*b*. Support frame structure 42 is thus a rigid frame structure which, when disposed over upright supports 12, 12*a* has sufficient strength and rigidity to support the raising and lowering of the boat lift.

Winch assembly 30 is removed from corner post 22*a* and is placed on its side with winch support post 31 lying on top of top frame member 45, to which it is connected by a pair of U-shaped, removable clamp members. Welded to and extending upwardly from sleeve member 43*b* is a mast 46 having cable guide means 47 connected to its upper end. In the embodiment shown, cable guide means 47 comprises a short length of chain having it upper end connected to mast 46 and a pulley attached to its bottom end.

Cable 34 is also disconnected from the boat lift and is extended through cable guide means 47 for attachment at its free end to a ring 48 bolted to the top end of corner post 22*c* of boat lift 20.

Figure 2:
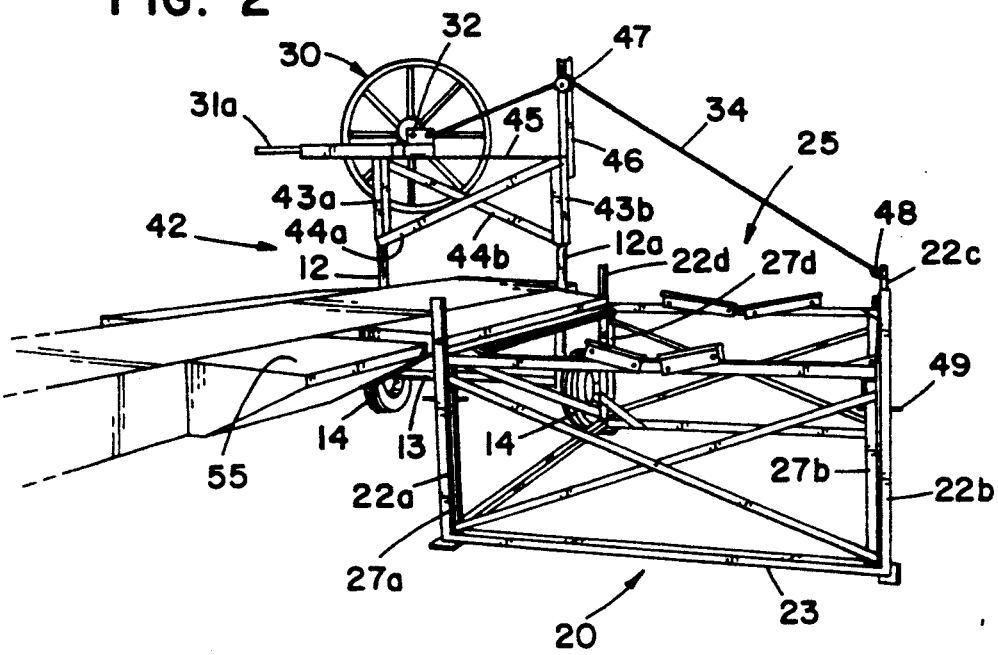
FIG. 2 is a fragmentary view in perspective similar to FIG. 1, but showing the hoisting mechanism mounted for lifting the boat lift onto the dock.

To provide an operator with space on which to stand to raise and lower the boat lift, the outer end 11*b* of deck 11 preferably extends beyond upright supports 12, 12*a* and support frame structure 42. To lock the lift frame 25 to the main frame 21 to provide a more rigid boat lift structure, pins 49 are provided which extend through aligned holes in the adjoining four sets of adjoining corner posts 22 and corner support members 27. With the pins 49 in position and the winch assembly 30 mounted on support frame structure 42, and with cable 34 connected as shown in FIG. 2, the assembly is positioned so that the boat lift 20 can be pivoted upwardly from a normal use position adjacent the dock as shown in FIG. 1 to a position on the dock platform as shown in FIG. 4.

Figure 3:
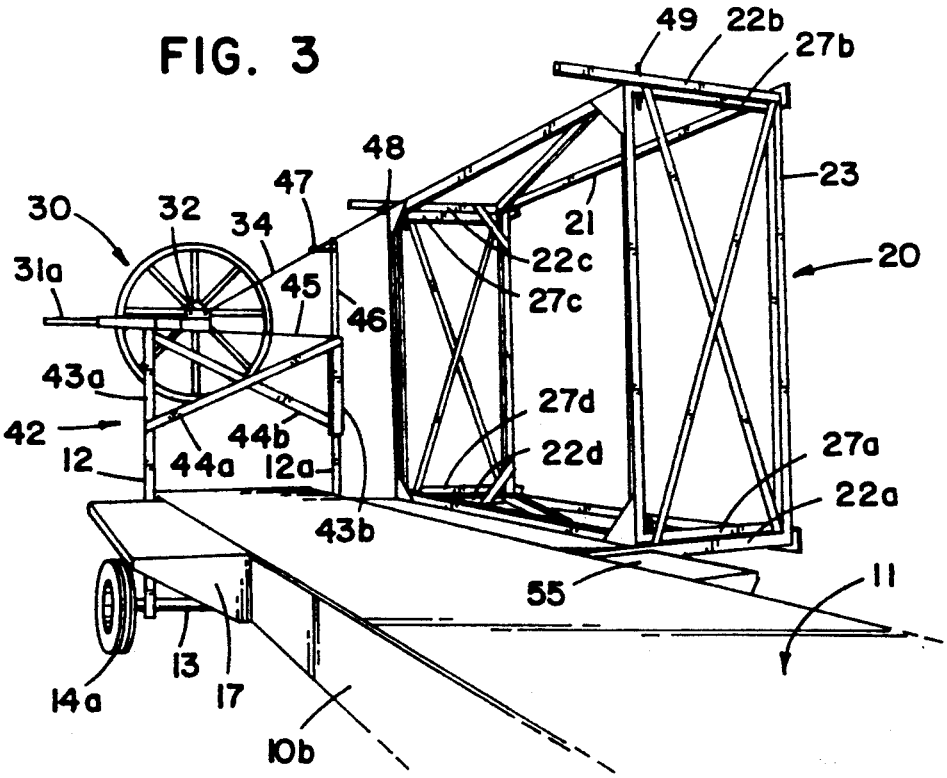
FIG. 3 is a fragmentary view in perspective taken from the other side of the dock showing the boat lift at an intermediate position.

To accomplish this, an operating standing on the end 11*b* of deck 11 rotates wheel 33 in a direction to pull the cable 34 toward the operator thus gradually lifting and rotating boat lift 20 about the hinge means or axis defined by pins 27 to an intermediate position shown in FIG. 3. It is noted that mast 46 is about the same height as the top of boat lift 20 when it reaches the position shown in FIG. 3. In addition, the chain 47 permits the attached pulley to move to accommodate the movement of boat lift 20. When boat lift 20 reaches the position shown in FIG. 3 and the movement continues, it moves over center so that it would fall onto the dock platform unless restrained. As boat lift 20 moves over center the direction of tension on cable 34 is reversed and the weight of boat lift 20 tends to draw cable 34 off winch 32. The operator can control this by reversing the direction of rotation of wheel 33 and by slowly rotating the wheel in the other direction to permit boat lift 20 to gradually move downwardly into the position shown in FIG. 4, where it rests on the platform formed by deck 11 and deck extensions 16, 17. It is noted that the top ends of corner posts 22*b*, 22*c* are then positioned over the outer corners of deck extension 17 and could be secured to deck extension 17 if desired. It is also noted that the platform formed by deck 11 and deck extensions 16, 17 is located just inside upright supports 12, 12*a* so that cable 34 has a fairly straight pull while at the same time permitting boat lift 20 to clear support frame structure 42 as it moves onto the platform.

Figure 4:
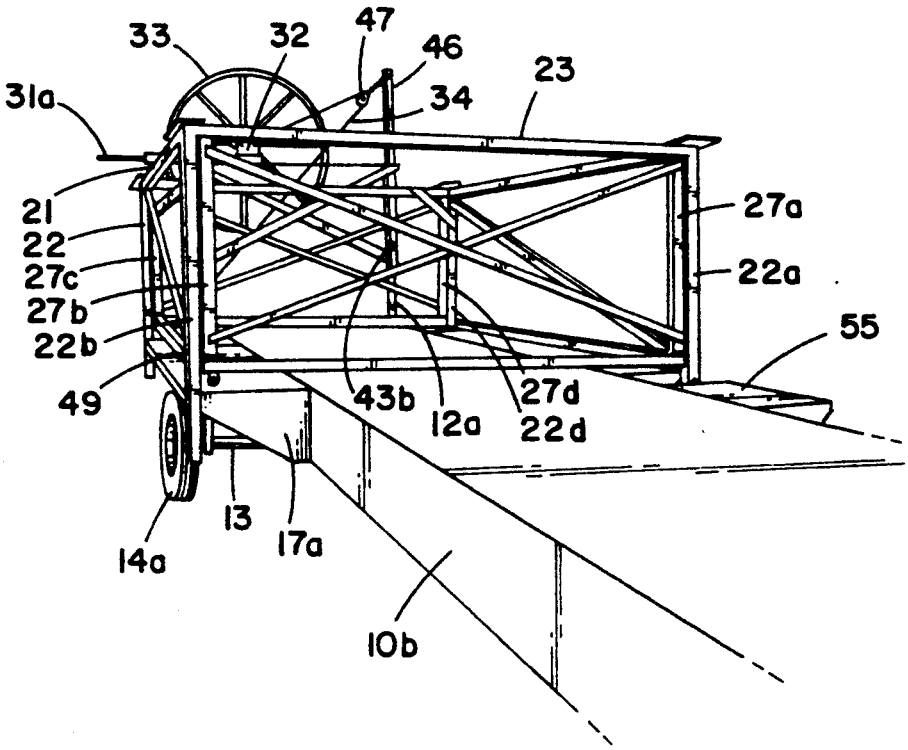
FIG. 4 is a fragmentary view in perspective similar to FIG. 3 but showing the boat lift resting on the dock platform in inverted position.

With the boat lift 20 located on the platform as shown in FIG. 4, a vehicle can be attached to portable dock 10 by means of hitch 41 to permit it to be pulled from the water carrying with it the boat lift 20. The combined dock and boat lift can then be parked or stored for the winter. When it is desired to place the unit back in the water, the combined dock and boat lift is rolled into the water until it reaches a proper location, with boat lift 20 being positioned on dock 10 as shown in FIG. 4. The procedure can then be reversed in order to swing boat lift 20 into the water. With boat lift 20 being located on the platform as shown in FIG. 4, an operator can rotate wheel 33 to draw in cable 34 and lift boat lift 20 to the position shown in FIG. 3 where it again moves over center, at which point the operator again reverses the direction of rotation of wheel 33 to gradually extend the cable 34 to lower boat lift 20 into the water to the position shown in FIG. 1. At that point winch assembly 30 can be removed from support frame structure 42 and placed in its normal position on corner post 22*a* for use during the season. Support frame structure 42 can then be removed and stored until it is again needed.

What is claimed:

1. A combination portable dock and boat lift structure, comprising:

(a) a portable dock having an elongated deck with inner and outer ends, and having a pair of upright supports extending above and below said deck on opposite sides thereof at said outer end, said supports having bottom ends connected to an axle carrying a pair of wheels;

(b) a boat lift having a main, generally rectangular frame including normally vertically extending corner posts, and a lift frame disposed therein having corresponding corner support members, and a removable winch and associated cable arrangement for raising and lowering said lift frame with respect to said main frame;

(c) said dock having oppositely disposed deck extensions mounted thereon to provide with said deck a support platform for said boat lift generally the same size as said boat lift (d) one of said deck extensions having outer corners disposed adjacent a pair of corner posts of said boat lift, and means for pivotally connecting said pair of corner posts to said outer corners so that said boat lift can be pivoted from a position adjacent said dock to a position on and supported by said platform; and (e) means for pivoting said boat lift between said positions comprising a mast mounted on the one of said upright supports adjacent said boat lift with cable guide means thereon, means including a support frame structure extending between said upright supports above said deck for mounting said winch thereon with said cable extending from said winch through said guide means for connection to an outer corner post of said main frame of said boat lift, said guide means being located a distance above said deck sufficient to permit said winch to be operated to lift and pivot said boat lift through an arc between its normal position adjacent said dock and an inverted position on said platform.

2. A combination dock and boat lift structure according to claim 1 wherein said support frame structure comprises a pair of tubular sleeve members sized to fit over said upright supports and connected by cross members to form a rigid frame.

3. A combination dock and boat lift structure according to claim 2 wherein said means for mounting said removable winch includes a winch support post which is normally connected to one of said boat lift corner posts, and means for connecting said winch support post to said support frame structure in a location spaced from and located below said cable guide means.

4. A combination dock and boat lift structure according to claim 3 wherein said winch support post is mounted on top of said support frame structure with the winch being located adjacent the one of said upright supports opposite said boat lift.

5. A combination dock and boat lift structure according to claim 3 wherein said deck outer end extends beyond said upright supports to provide a deck area on which an operator can stand to operate said winch to raise or lower said boat lift.

6. A combination dock and boat lift structure according to claim 1 wherein means are provided to lock together said main frame and lift frame of said boat lift during raising or lowering thereof.

7. A combination dock and boat lift structure according to claim 1 wherein said deck extensions are affixed to opposite sides of said dock and wherein the length of said one deck extension is such that the outer corners fit between said pair of corner posts, and wherein said connecting means comprise pins extending through said corner posts into said outer corners of said deck extension.

8. A combination portable dock and boat lift, comprising:

(a) a portable dock having wheels, an elongated deck and a pair of upright deck supports extending above and below said deck on opposite sides thereof connected to said wheels;

(b) a boat lift having a main frame and a lift frame disposed therein, and means including a removable winch and associated cable arrangement for raising and lowering said lift frame with respect to said main frame;

(c) said dock having oppositely disposed deck extensions to provide with said deck a support platform for said boat lift;

(d) means for pivotally connecting said boat lift to said platform so that said boat lift can be pivoted from a position adjacent said dock to a position on and supported by said platform; and (e) means for pivoting said boat lift between said positions comprising a mast mounted on said dock adjacent said boat lift with cable guide means thereon, means for mounting said winch on said dock with said cable extending from said winch through said guide means for connection with said main frame of said boat lift, said guide means being located a distance above said deck sufficient to permit said winch to be operated to lift and pivot said boat lift through an arc between its normal position adjacent said dock and an inverted position on said platform.

9. A combination portable dock and boat lift according to claim 8 wherein said dock has inner and outer ends and said upright deck supports are located at said outer end, and wherein said mast is mounted on one of said upright deck supports.

10. A combination portable dock and boat lift structure according to claim 9 including a support frame structure extending between said upright deck supports above said dock for mounting said winch thereon.

11. A combination dock and boat lift according to claim 10 wherein said support frame structure comprises a pair of tubular sleeve members sized to fit over said upright deck supports and connected by cross members to form a rigid frame.

12. A combination dock and boat lift according to claim 11 wherein said boat lift includes normally vertically extending corner posts, wherein said means for mounting said removable winch includes a winch support post which is normally connected to one of said boat lift corner posts, and means for connecting said winch support post to said support frame structure in a location spaced from and located below said cable guide means.

13. A combination dock and boat lift according to claim 12 wherein said winch support post is mounted on top of said support frame structure with the winch being located adjacent the one of said upright supports opposite said boat lift.

14. A combination dock and boat lift according to claim 12 wherein said deck outer end extends beyond said upright dock supports to provide a deck area on which an operator can stand to operate said winch to raise or lower said boat lift.

15. A combination dock and boat lift according to claim 12 wherein said deck extensions are affixed to opposite sides of said dock and wherein the length of one deck extension is such that outer corners thereof fit between a pair of boat lift corner posts, and wherein said means for pivotably connecting said boat lift to said platform comprises pins extending through said corner posts into said outer corners of said deck extension.

16. A combination dock and boat lift according to claim 8 wherein means are provided to lock together said main frame and lift frame of said boat lift during raising or lowering thereof.

17. A portable dock and boat lift, comprising:

(a) a portable dock having a deck;

(b) a boat lift;

(c) said deck having a portion comprising a support platform for said boat lift;

(d) means for pivotally connecting said boat lift to said platform so that said boat lift can be pivoted from a position adjacent said dock to a position on and supported by said platform; and (e) hoist means including hoist guide means above said deck and connected to said boat lift to allow said boat lift to be lifted, pivoted over center, and released to rest in inverted position on said support platform.

18. A portable dock and boat lift according to claim 17 wherein said last named means comprises a mast mounted on said dock adjacent said boat lift with guide means thereon, means for mounting said hoist means on said dock including a line controlled thereby extending from said hoist means through said guide means for connection with said boat lift, said guide means being located a distance above said deck sufficient to permit said hoist means and line to be operated to lift, pivot over center, and then release said boat lift to move it between a normal position adjacent said dock and an inverted position on said platform.

19. A portable dock and boat lift according to claim 18 including:

(a) said portable dock having an elongated deck with inner and outer ends, and a pair of upright supports extending above and below said deck on opposite sides thereof at said outer end, said supports having bottom ends connected to an axle carrying a pair of wheels;

(b) said boat lift having a main, generally rectangular frame including normally vertically extending corner posts, a lift frame disposed therein having corresponding corner support members, and said hoisting device and line comprising a removable winch and associated cable arrangement for raising and lowering said lift frame with respect to said main frame;

(c) said dock having oppositely disposed deck extensions mounted thereon to provide with said deck said support platform for said boat lift generally the same size as said boat lift;

(d) one of said deck extensions having outer corners disposed adjacent a pair of corner posts of said boat lift, and means for pivotally connecting said pair of corner posts to said outer corners so that said boat lift can be pivoted from a position adjacent said dock to a position on and supported by said platform; and (e) said means for pivoting said boat lift between said positions comprising said mast being mounted on the one of said upright supports adjacent said boat lift with said cable guide means thereon.

20. A portable dock and boat lift according to claim 19 wherein means including a support frame structure extend between said upright supports above said deck for mounting said winch thereon with said cable extending from said winch through said guide means for connection to an outer corner post of said main frame of said boat lift, said guide means being located a distance above said deck sufficient to permit said winch to be operated to lift and pivot said boat lift through an arc between its normal position adjacent said dock and an inverted position on said platform.

21. A portable dock and boat lift according to claim 20 wherein means are provided to lock together said main frame and lift frame of said boat lift during raising or lowering thereof.

22. A portable dock and boat lift according to claim 20 wherein said deck extensions are affixed to opposite sides of said dock and wherein the length of one deck extension is such that outer corners thereof fit between a pair of boat lift corner posts, and wherein said means for pivotably connecting said boat lift to said platform comprise hinge means connecting said corner posts and said outer corners of said deck extension.

23. A combined dock and boat lift, comprising:

(a) a dock having a deck;

(b) a boat lift;

(c) means for pivotally connecting said boat lift to said dock so that said boat lift can be pivoted from a position adjacent said dock to an inverted position on and supported by said deck; and (d) hoist means including hoist guide means above said deck and connected to said boat lift to allow said boat lift to be lifted, pivoted over center, and released to rest in inverted position on said deck.

* * * * *